US010385585B2

(12) United States Patent
Johnstone

(10) Patent No.: US 10,385,585 B2
(45) Date of Patent: Aug. 20, 2019

(54) TOOL FOR USE IN THE FENCING INDUSTRY OR LIKE

(71) Applicant: Illinois Tool Works Inc., Glenview, IL (US)

(72) Inventor: Christopher Henry Johnstone, Hamilton (NZ)

(73) Assignee: ILLINOIS TOOL WORKS INC., Glenview, IL (US)

( * ) Notice: Subject to any disclaimer, the term of this patent is extended or adjusted under 35 U.S.C. 154(b) by 832 days.

(21) Appl. No.: 14/185,947

(22) Filed: Feb. 21, 2014

(65) Prior Publication Data

US 2015/0240519 A1 Aug. 27, 2015

(51) Int. Cl.

| | |
|---|---|
| ***B25B 7/02*** | (2006.01) |
| ***E04H 17/26*** | (2006.01) |
| ***B25B 7/22*** | (2006.01) |
| ***B25B 7/08*** | (2006.01) |
| ***B25B 25/00*** | (2006.01) |
| ***B25C 11/02*** | (2006.01) |
| *B25B 7/12* | (2006.01) |

(52) U.S. Cl.

CPC ..... *E04H 17/268* (2013.01); *B25B 7/02* (2013.01); *B25B 7/08* (2013.01); *B25B 7/22* (2013.01); *B25B 25/00* (2013.01); *B25C 11/02* (2013.01); *B25B 7/12* (2013.01)

(58) Field of Classification Search

CPC .... B25B 7/08; B25B 7/02; B25B 7/22; B25B 25/00; B25C 11/02

USPC ..... 7/117

See application file for complete search history.

(56) References Cited

U.S. PATENT DOCUMENTS

| | | | | |
|---|---|---|---|---|
| 218,082 A | | 7/1879 | Taylor | |
| 876,963 A | | 1/1908 | Hoak | |
| 1,549,919 A | * | 8/1925 | Newman | B25B 7/02 254/28 |
| 1,644,352 A | * | 10/1927 | Perrin | B25F 1/006 140/121 |
| 2,520,808 A | * | 8/1950 | Miller | B25G 1/12 16/431 |
| 2,929,415 A | * | 3/1960 | Miesner | F16G 11/12 140/121 |
| 3,010,347 A | * | 11/1961 | Kron | B25B 13/12 7/139 |
| 4,315,447 A | * | 2/1982 | Tartaglia | B25B 7/02 81/185.1 |
| 4,499,798 A | * | 2/1985 | Miskiewicz | B25B 7/04 81/423 |

(Continued)

FOREIGN PATENT DOCUMENTS

| | | |
|---|---|---|
| BE | 344564 A | 9/1927 |
| NZ | 597390 B | 10/2013 |

*Primary Examiner* — Monica S Carter
*Assistant Examiner* — Danny Hong
(74) *Attorney, Agent, or Firm* — Burr Forman McNair

(57) ABSTRACT

Tools including a jaw portion, a hinge portion, and a handle portion are provided. The jaw-portion may include a pair of jaws. The hinge portion may generally be configured to allow each jaw of the pair of jaws to pivot between open and closed positions relative to each other and form an aperture adjacent a tip of each of the pair of jaws when the jaws are in the closed position. The handle portion may be located on the opposite side of the hinge portion to the jaw portion to allow for opening and closing of the pair of jaws.

23 Claims, 5 Drawing Sheets

(56) References Cited

U.S. PATENT DOCUMENTS

| | | | | |
|---|---|---|---|---|
| 4,892,015 | A * | 1/1990 | Beetz | H02G 1/1212 81/9.41 |
| 6,443,515 | B1 * | 9/2002 | Wu | B25B 13/10 269/282 |
| 7,421,771 | B2 * | 9/2008 | Heathman | B25B 13/02 29/426.5 |
| 7,712,398 | B2 * | 5/2010 | Chuang | B25B 27/205 81/423 |

* cited by examiner

TOOL FOR USE IN THE FENCING INDUSTRY OR LIKE

TECHNICAL FIELD

The present disclosure relates generally to an improved tool for use in a variety of industries, such as the fencing industry, power utility applications, or the like. In particular, the present disclosure relates to a pair of pliers suitable for the removal of staples from timbers and the tensioning of fence wires.

BACKGROUND

The present disclosure addresses problems in the fencing industry but may find application in other areas. For simplicity of description, example embodiments of the invention will be described with the problems and considerations of the fencing industry in mind.

Many farm fences are of wire construction. Posts are placed at intervals and multiple parallel wires are strung between them. To help maintain the relative tension of the wires and keep them spaced apart, floating (i.e. not planted or secured to the ground) battens are regularly spaced between the posts. These are often of wood, and typically around 40×40 mm in cross-section.

The fence wires are usually fastened to the battens and posts by means of fence staples—U-shaped nails that accommodate the wire in their crook. While easy to hammer in, they are actually very difficult to remove—especially without damaging the fence wire.

Normally, staples only need to be removed during fence repairs—occasionally battens need to be replaced or a section of fencing may be altered. In both cases, it is usually a case of trying to repair the fence rather than replacing it. Accordingly it is desirable that the fence wires remain intact and are not damaged. However, trying to remove staples (especially barbed staples) with traditional means often results in damage of the fence wire, such as stripping of the galvanized coating on a fence wire that leads to oxidation, rust, and fence line degradation leading to costly repair.

The main causes of damage relate to the fact that the crook of a staple is quite small and sometimes smaller than the actual diameter of the wire. Hence the area of the crook is completely filled with wire, making it difficult to lift the staple without the wire (lifting the wire can damage or introduce a weak point into the wire). Sometimes also, in softwood battens, the staple can be overdriven into the batten, making it even harder (using conventional means) to lift the staple. Quite a degree of force is required to lift a staple, often requiring some leverage to pull up the staple. Known pliers have jaws with a rounded head (like the claw of a hammer) to provide some leverage to pull the staple out (like a conventional nail with a claw hammer). One problem with such pliers, however, is that the rotating leverage applied by traditional pliers is transverse to the length of the batten. Since most battens are around 40 mm wide, it is very difficult to effectively use traditional pliers to pull out staples from battens—you can pull the staples a short distance if you are lucky, but can't get any further leverage due to the lack of an adequate support surface (i.e. you are limited by the width of the batten).

Secondly, most traditional pliers for use in fencing are crimping pliers, for crimping wire joiners/sleeves. Due to the force required to compress the joiners/sleeves, they are typically designed for two handed use. In contrast, a one handed plier suitable for removing staples will be quicker and easier to use, and will potentially speed up repair jobs for the user.

Hence, batten replacement is an often onerous and tedious job and typically results in damage to the fence wire.

Accordingly there is a need to provide an improved process and/or apparatus capable of more effectively removing metal fence staples from fence battens.

Accordingly there is a need to provide apparatus capable of removing metal fence staples from fence battens and posts, and which can be used substantially with one hand.

Another issue which also needs to be addressed is tensioning the fence wires as they are stapled to fencing battens and posts during repairs, temporary fences, and new installations. For a new fence, specialized wire strainers are generally used to tension wires at the strainer posts. However, sometimes a farmer needs to apply tension to a wire during a repair, or when putting up a temporary fence.

Not all farmers have specialized wire strainers/tensioners, as they are a specialized professional tool aimed at fencing contractors. Further, it is not generally something the farmer will carry around (typically on their quad-bike as they travel around the farm) as specialized strainers are only occasionally used. Hence, if in a remote area of the farm the farmer notices that a small repair needs to be made, they will need to make a special trip back to the toolshed to retrieve their wire strainer or (most likely) improvise with some other tool—typically a pair of standard or fencing pliers, though it is very difficult to apply a good degree of tension on a wire using these tools and any repair will need to be followed up and done properly.

Accordingly, there is also a need for a tool which is readily able to be carried around as part of a farmer's standard tool kit, and which can easily allow a farmer or fencer to apply a good degree of tension on a fencing wire during various uses such as repairs, and stringing temporary fences.

BRIEF SUMMARY

The present invention, according to a first aspect, comprises pliers for use in removing staples (e.g., fencing staples), but may find other uses. Pliers according to certain embodiments of the present invention comprise a jaw portion, a hinge portion (allowing the jaws of the jaw portion to open and close), and a handle portion (for effecting opening and closing of the jaws).

In some embodiments, a tool in the form of a pair of pliers for use in removing fencing staples is provided, but the tool may find other uses as well. For example, the tool is useful for for removing staples in power utility applications (wooden power poles) where the confines of the elevated bucket (or cherry picker) that is used by the linesman along with the bulky protective gloves the linesmen wears makes the feature of the one handed staple removal, the long handles and the carefully weighted handle that opens without having to prise the tool open very helpful. The one handed operation feature of the tool of the present invention is an advantage over known two handed operative tools which can be clumsy and bulky to use thereby improving linesman safety.

The handle portion may take a number of different forms. The main considerations may include the handles of the handle portion being sufficiently robust for use in the field, resistance to corrosion, and being able to provide enough mechanical force to the jaws for them to perform their function (though different hinge designs can influence the effective leverage). Other considerations may include comfort, grip (avoiding slipping in wet conditions), and various ergonomic considerations. The shape of the handle is preferably straight with a relatively long length of approximately 190 mm. This configuration provides enough leverage and avoids the tool being too clumsy during use.

The hinge portion may also incorporate various hinge designs. A simple single pivot, for example, connecting the jaws may be used, though multiple pivot point hinges, and hinges with various mechanical linkages to improve leverage (etc.) may also be considered. These latter designs may be considered more closely when the jaws provide additional functionality, such as the ability to cut wire, or to crimp wire crimps/joiner-sleeves.

The jaw portion, in accordance with certain embodiments of the present invention, may comprise two jaws pivotable between open and closed positions. The jaws have tips, which may be located at the end portions distal the pivot. The jaws may be substantially planar, or the ends (adjacent and including the tips) may be bent out of plane (the plane being the general pivoting plane in which the arc of opening and closing of the jaws lie).

In certain embodiments, the tips (ideally the tip of both jaws, but only the tip of one jaw needs to possess this feature) are of reduced cross-section and may be tapered. This allows the tip(s) to more effectively insert into the crook of the staple and ideally above the wire. As most staples are of wire of round cross-section, suitable tapering can allow the user to wiggle/manipulate the fine tip between the wire and staple.

In accordance with certain embodiments of the present invention, at least one of the tips should be able to insert into the crook of a 4 mm staple—if both tips are tapered or of reduced cross-section then each tip need only insert, for example, as far as halfway. A versatile tool, in accordance with certain embodiments of the present invention, can fit into the crook of the most commonly used staple, such as a 2.5 mm staple but could be in the range 1.6 mm to 4.5 mm.

An aperture may be defined adjacent the tips, in accordance with certain embodiments of the present invention, when the jaws are closed. This is to accommodate the head of the staple while it is being lifted. As one of skill in the art may appreciate, in certain embodiments the staple head may be, rather than being gripped and pulled, actually being supported underneath and lifted. This is quite different to prior art designs which do not readily provide this functionality.

In certain embodiments, the outer surface of the jaws may be rounded (like the outer head of a claw hammer), though this is a matter of user choice. However, this allows for the pliers to lift various fasteners (etc.) providing there is a suitable support surface.

Embodiments of the present invention may comprise at least one stud-like projection on at least one jaw (or on both if desired). The stud-like projection extends outwardly from the general planar surface of the jaw. This may be better explained as follows:

a. in a substantially planar jaw set (e.g., no bent out-of-plane tip portions) the general planar surface is also the plane of pivoting (as mentioned before);
b. in a case where the ends of the jaws are bent out of the pivoting plane, then the stud-like projections extend from the general plane of the end portions of the jaws which are bent out of plane.

The stud-like projections are configured to provide a contact point for leverage. Hence, instead of relying on pivoting leverage in one plane (such as described above where some embodiments may use the outer surface of the jaws like a claw hammer), the pliers can be levered in a plane orthogonal to the pivoting plane. A significant potentially realizable advantage is that (due to the orientation of an inserted staple) the claw-hammer type leverage action is limited as it acts across the width of the batten (which is not wide enough for a staple to be more than slightly pulled out). In contrast, the stud-like projections provide a fulcrum for leverage along the length of the batten, which is more effective.

Further, given that in certain embodiments the stud-like projections are positioned near to the tip of the jaws for maximum leverage, they also allow the pliers to be more effectively used (much more so than the claw hammer type action) transversely across the width of a batten. Hence there is the provision for a potentially more useful and effective levering action.

These stud-like projections can be provided on just one, or both, sides of a jaw though certain embodiments have the projection on only one side (as the free sides gives a better view of what is happening near the tip).

The exact shape of the stud-like projection is not necessarily important in accordance with certain embodiments of the present invention. In certain embodiments, for example, providing such stud-like projection(s) can provide an effective contact point (primary load bearing area) on a support surface to act as a fulcrum. Various embodiments (by way of example) may have projections substantially of the following general shapes (but need not be limited to same)—cylindrical, conical, frustoconical, pyramidal, cuboid, and a parallelepiped.

The height of the projection (at the contact/load bearing area) above the general surface of the jaw with which it is associated may comprise generally 7.5 mm or more. Measuring from the center plane of the jaw (this plane being through the centre of the jaw and parallel to the pivoting plane (see above), except in the case of bent tip pliers in which case it is the center plane of the tip/end portion of the jaws), the projection may extend at least 12.5 mm therefrom. There is room for user optimization here, for specific applications.

The contact/load bearing area of the projections should be close to the top of the jaws. This is best referenced to a tangential line across the top of the tips of the closed jaws, wherein the tangential line being substantially perpendicular to the axis of symmetry as the jaws open outwardly into an open position (and best seen in the accompanying diagrams).

In certain embodiments, the contact/primary load bearing area of a projection, at its distance of closest approach to said tangential line, should be within the inclusive range of 1 to 10 mm.

In terms of the distance of separation of the projections present on two closed jaws, their distance of closest approach may comprise within the range of 10 to 30 mm.

Another aspect of the invention comprises a wire gripping portion in conjunction with stud-like projections such as described above. In combination, the projections allow greater leverage to be applied to tension a wire. In simple tests by the inventor, tensions of around 100-150 kgf can be readily obtained without too much effort—150 kgf being the recommended tension for most farm fences.

However, in further trials, certain embodiments of the invention utilize pliers with a double pivot arrangement. Here, there is quite a different type of wire gripping portion. In certain embodiments, the wire gripping portions comprise two wire contacting face portions, of which one is actually present on the outside face of one of the primary elements of the pliers—a primary element being one of the two main body parts of most preferred embodiments of the invention, and characterized in that one end comprises a jaw portion and the opposite end comprises a handle portion.

The other primary element comprises an extended body modification or element which presents a wire contacting face portion which is able to close against the wire contacting face portion on the outer edge/face of the first primary element. This arrangement will be clearer in the drawings.

When this gripping arrangement is used there is effectively a cam closing action between the two wire contacting face portions, and particularly when a double pivot is used. This provides a relative lateral motion between the wire contacting face portions as their distance of separation alters. It has been found in preliminary trials by the inventor that this subjectively seems to provide a slightly firmer gripping action on the wire being grasped. The cam closing action also seems to provide a finer closing action on the wire, particularly on a double pivot type plier. As the handles are closed at a constant rate, the rate of closure of the two wire closing portions slow slightly, the closer they come together. This gives the user slightly more control on gripping pressure, particularly if using a wire type which can be easily damaged.

In a prototype of this embodiment, preliminary bench tests by the inventor indicated that the nominal wire tension of 150 kgf could be readily achieved without too much effort and using one hand—leaving the other hand free to secure the wire to a post, etc.

According to one aspect of the present invention there is provided a tool comprising: (i) a jaw portion comprising a pair of jaws; (ii) a hinge portion configured to allow each jaw of the pair of jaws to pivot between open and closed positions relative to each other and form an aperture adjacent a tip of each of the pair of jaws when the jaws are in the closed position; (iii) a handle portion on the opposite side of the hinge portion to the jaw portion to allow for opening and closing of the pair of jaws; and (iv) at least one projection extending outwardly from each of the pair of jaws in the plane within which the jaws pivot; wherein the top surface of the projections distal the jaw from which the projection extends, are configured to contact a support surface and act as a fulcrum for applying a levering force to an article grasped by the jaws when in the closed position.

In certain embodiments, the shape of the projections is selected from the group consisting of: cylindrical, conical, frustoconical, pyramidal, cuboid, and a parallelepiped. The projection may extend a minimum of 7.5 mm from the face of each of the pair of jaws. In certain embodiments, the projections extend a minimum of 12.5 mm from the said center plane of each of the pair of jaws. In certain embodiments, the projections are integrally formed into each of the pair of jaws. A cross-sectional area of the top surface of the projections, according to certain embodiment, may comprise at least 20 $mm^2$. The top surface of the projections, according to certain embodiments, may comprise a gripping or anti-slip surface. In accordance with certain embodiments, the top surface of the projections when the pair of jaws are in a closed position, comprises within the inclusive range of 1 to 10 mm of a tangential line at the tip of each of the pair of jaws, said tangential line being substantially perpendicular to the axis of symmetry as the jaws open outwardly into the open position. The distance of closest approach between the primary load-bearing areas of the projection on each jaw when the pair of jaws is in the closed position, in certain embodiments, may comprise within the inclusive range of 8 to 35 mm.

In certain embodiments, the aperture comprises a substantially circular shape. The aperture may, in accordance with certain embodiments, accommodate a wire with a diameter in the range 1.6 mm to 4.5 mm.

In certain embodiments, the hinge portion comprises a single pivot connecting the pair of jaws. The hinge portion may comprise, in certain embodiments, a multiple pivot point hinge arrangement with mechanical linkages connecting the pair of jaws. In certain embodiments, the jaw portions are integral with the handle portion.

In certain embodiments, the handle portion comprises one or more of the following features: cushioning, gripping modifications, moulded portions for accommodating fingers, closure limiting features setting the minimum distance of approach when the pliers are in a closed position, are telescoping.

In certain embodiments, the jaw portion comprises additional features, such as a wire cutting feature. Certain embodiments of the present invention may comprise a jaw portion comprising a cable crimping feature.

In certain embodiments, the tip of at least one jaw of the pair of jaws is fine enough to insert and fit at least half-way under the crook of a 2.5 mm gauge fencing staple. The tip, in certain embodiments, of at least one jaw of the pair of jaws is fine enough to insert and fit at least half-way under the crook of a 4 mm gauge fencing staple.

In accordance with certain embodiments, the tip of at least one jaw of the pair of jaws is tapered towards its end. In certain embodiments, the tip of at least one jaw of the pair of jaws comprises less than 1.75 mm across. The cross sectional area of the tip of at least one jaw of the pair of jaws, in certain embodiment, may comprise less than 2 $mm^2$.

In certain embodiments, the jaw portion may comprise a metal, such as a stainless steel or an alloy steel.

In certain embodiments, the tip of each jaw of the pair of jaws may be bent out from the plane of jaw pivoting.

In certain embodiments, the tool also comprises a wire gripping portion positioned between the hinge portion and the handle portion and comprising a pair of wire contacting surfaces configured to contact each other as the handle portion is biased to move each jaw of the pair of jaws to the closed position.

In certain embodiments, the jaw portion and the handle portion may be connected by a pivot assembly comprising a double pivot arrangement.

In certain embodiments, one of the wire contacting portions may be positioned on an outer edge or face of one of the primary elements.

In certain embodiments, one of the wire contacting portions comprises a portion on a primary element which closes against a wire contacting portion on the outer face of the other primary element. In accordance with certain embodiments, the wire contacting portions may be positioned between the pivot assembly portion and the handle portions of the pliers. In certain embodiments, the closing of the pliers causes the two wire contacting portions to come together in a cam-like action.

According to another aspect, the present invention provides for methods of using a tool, according to certain embodiments of the present invention as described herein, for removing staples from a fence batten.

BRIEF DESCRIPTION OF DRAWINGS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

DETAILED DESCRIPTION

The present invention now will be described more fully hereinafter with reference to the accompanying drawings, in which some, but not all embodiments of the inventions are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

In accordance with certain embodiments of the present invention, and with reference to FIGS. 1 to 4, an improved tool for use in the fencing industry or the like is generally indicated by arrow 1.

Figure 1:
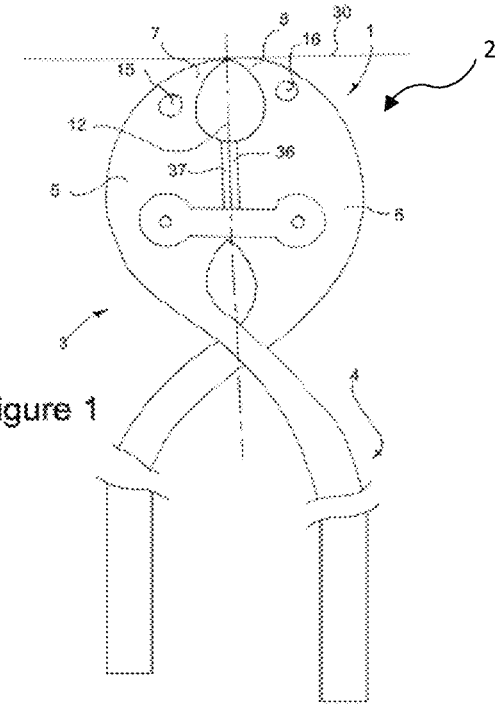
FIG. 1 shows a diagrammatic front view of one embodiment of the present invention in the form of a pair of pliers.

With reference to FIG. 1 a pair of pliers is generally indicated by arrow 1. The pliers (1) comprise a jaw portion (generally indicated by arrow 2), a hinge portion (generally indicated by arrow 3), and a handle portion (generally indicated by arrow 4).

The jaw portion (2), as illustrated in FIGS. 1-4, comprises a first (5) and second (6) jaw. The tip (7, 8) of each jaw (5, 6) respectively is tapered to a relatively fine tip to facilitate insertion into the crook of a fence staple (10) and above the wire (11). The aperture (12) formed between the closed jaws (5, 6) accommodates the head of the staple to prevent it being cut or damaged (making removal impossible).

Figure 2:
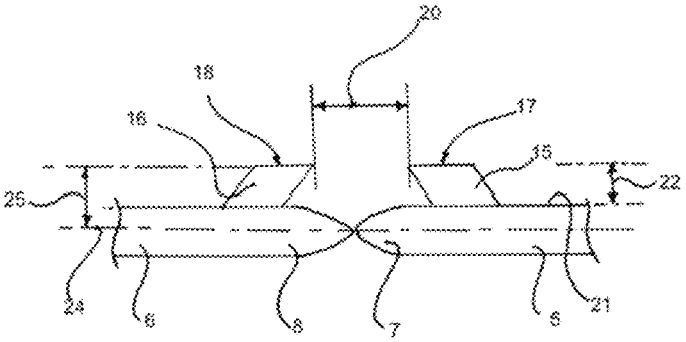
FIG. 2 shows a top end view of the jaw portion of the embodiment shown in FIG. 1.
Figure 3:
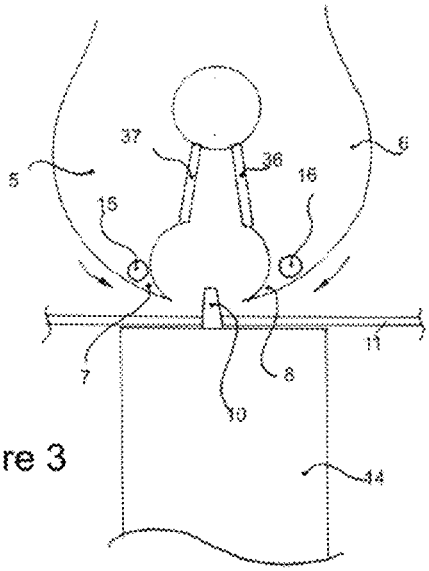
FIG. 3 shows a partial front view of the embodiment shown in FIG. 1 in typical use.

In accordance with certain embodiments illustrated by FIGS. 1-4, adjacent the tips (7, 8) are raised stud-like projections (15, 16) whose top surfaces (17, 18) (primary load bearing surface) can act as fulcrums. Their distance of closest approach to each other (indicated by line 20) may comprise within the inclusive range of 10 through 20 mm. FIG. 2 shows the case of inwardly slanted projections, by way of example only.

Referring to FIG. 2, the primary load bearing surface (17, 18) rises above the face (21) of the jaw (5) by distance (22) which may comprise at least 7.5 mm. Alternatively the height can be measured from the center plane (24) of the jaw (6) by distance (25) which may comprise at least 12.5 mm.

The projections (15, 16) should also be close to the top of the jaws (5, 6). This is best reference by the distance of closest approach to a tangential line (30; see FIG. 1) perpendicular to the axis (31) of opening symmetry for the jaws. This distance of approach may comprise within the inclusive range of 1 to 10 mm.

Figure 4:
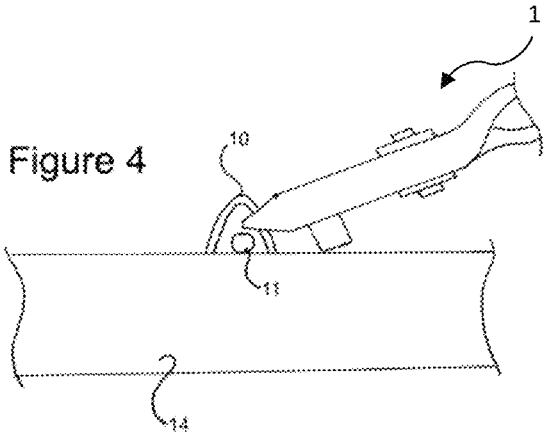
FIG. 4 shows a side view of the embodiment shown in FIG. 1 in typical use.

In use, the tips (7, 8) of the jaws (5, 6) may be inserted under the staple (10) and above the wire (11; see FIG. 3) and the projections (15, 16) used as a fulcrum for leverage and using the batten (14) as a support surface (see FIG. 4). This allows the pliers (1) to act as a lever along the length of the batten, though the user can change the angle and use the pliers (1) transversely (across the batten) as well—the close proximity of the projections (15, 16) to the top (30) of the jaws (5, 6) allows this despite the narrowness of a typical batten (14).

In accordance with certain embodiments, the projections (15, 16) may also provide (or function) as a bridge across the wire when levering a staple out of timber. As such, the user can avoid "squashing" the fence wire as the staple is rotated and/or levered out of the timber on that side access point.

The projections (15, 16) also span across the fence wire (11) avoiding contact with the wire (11) when levering the staple (10) out of the batten (14). In this way, the wire (11) is not crushed on the side of the tool (1) that the projections (15, 16) act as a fulcrum as the staple (10) is rotated out of the batten (14). This wire damage can be a problem with known staple removing tools which can cause stripping of the galvanized coating of the wire which leads to oxidation, rust and wire failure leading to costly repairs.

The projections (15, 16) can also be used to wind a fence wire (11) as an alternative to a known daisy type wire tensioner device. In use, the fence wire is placed between the projections (15, 16) and the tool rotated while the pair of jaws (5, 6) grips the wire (11). In this way the wire is effectively coiled up increasing its tension. During this use the body of the tool (1) would need to be resting against the batten (14) to increase wire tension by using the projections (15, 16) in conjunction with the wire gripping portion (101) using the winding action.

A person skilled in the art will appreciate that the projections (15, 16) could take different forms without departing from the scope of the present invention. For example, the exterior surface of the projections (15, 16) can either have a smooth exterior surface or comprise an indentation U-shaped guide around the circumference of each projection (15, 16).

Figure 5:
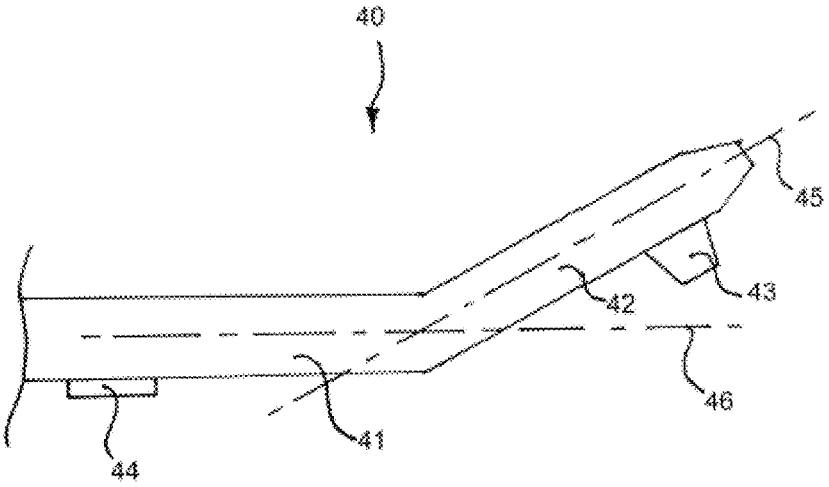
FIG. 5 shows a side view of another embodiment of the present invention in the form of a pair of pliers with a bent nose portion.

FIG. 5 illustrates a bent tip jaw embodiment (generally indicated by arrow 40). Here the jaws (41—only one jaw visible in image) are connected by pivot (44), though the end portion (42) of the jaw (41; both jaws) are bent (centre plane 45) out of the plane of pivoting (46). The pliers work in substantially the same way as the other embodiments using projection 43.

Certain embodiments may include features such as wire cutters (36, 37; see FIGS. 1 and 3) though certain embodiments could also include other features such as wire joiner crimpers (e.g. for crimp/sleeve type joiners).

Figure 6:
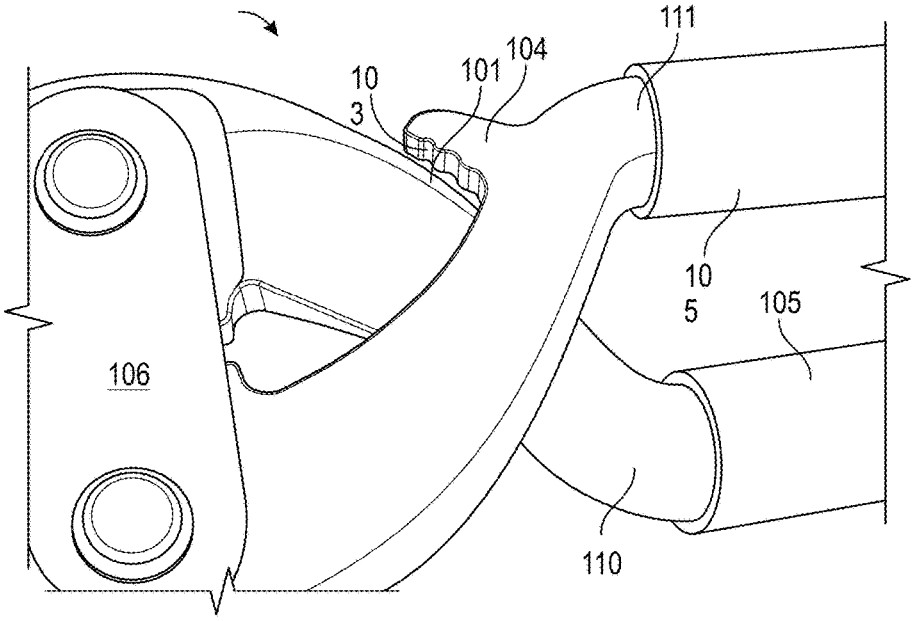
FIG. 6 shows a perspective view of another embodiment of the present invention in the form of a pair of pliers incorporating a wire gripping portion.

FIG. 6 illustrates a further embodiment of the present invention, incorporating a wire gripping portion (generally indicated by arrow 101). This may be located between the pivot (106) and handle (105) portions of the pliers, in accordance with certain embodiments.

The embodiment shown in FIG. 6 includes a wire gripping portion (101) comprising a first wire contact face portion (102) on the outer edge/face of a first primary element (110), and a second wire contact face portion (103) on an extended body portion (104) on the second primary element (111).

When the pliers are in a closed position, there is optionally a small distance of separation between the wire contacting face portions (102, 103) to reduce likelihood of damage to a typical wire.

Positioning the wire gripping portion (101) on the outer face of the pliers in the manner generally illustrated in FIG. 6 also provides a further potentially realizable advantage—it makes it easier, in use, for a user to guide a wire within the wire gripping portion (101) as opposed to those of the prior art where the wire is grasped in a position between the handle portions. This can be quite an important feature when tensioning wires in cold, wet, or extreme conditions in the field.

Figure 7:
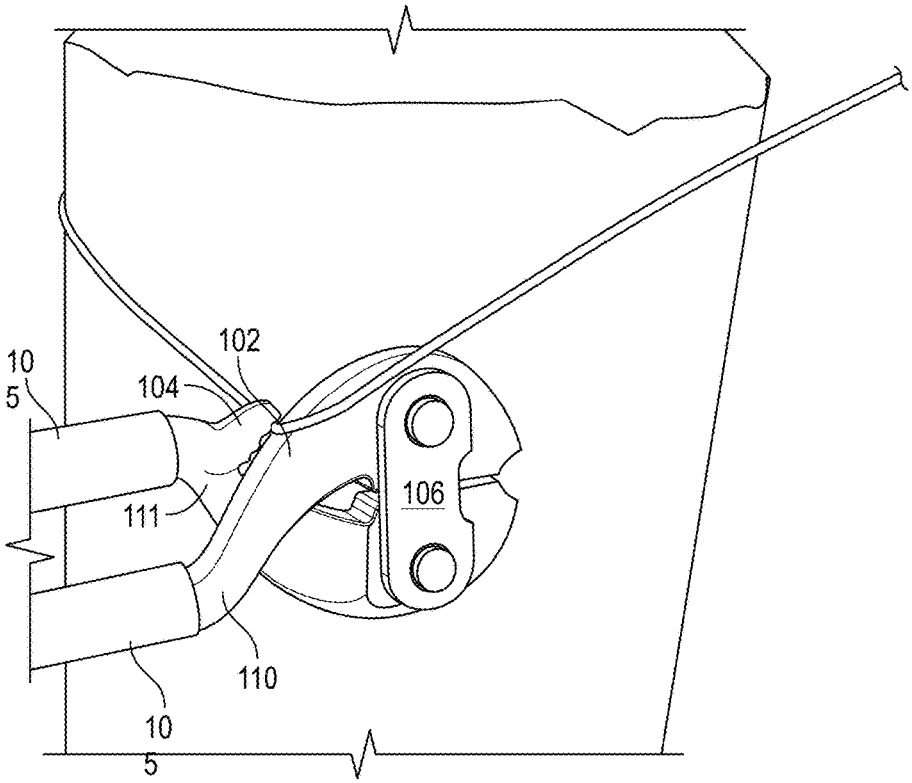
FIG. 7 shows a perspective view of the embodiment shown in FIG. 6 gripping a length of wire and tensioning it.

FIG. 7 illustrates a method of using of the embodiment shown in FIG. 6, where a length of wire (not numbered) is grasped between the wire contacting face portions (102, 103). The stud like projections (15, 16), which are not visible in FIG. 7, are positioned against the post and act as a fulcrum as the handles are pivoted away from the post to provide tension on the wire. The stud projections potentially provide a good grip against the post and help avoid slipping. Hence the wire gripping portion in conjunction with the stud like projections can potentially provide additional advantage over the prior art.

In accordance with certain embodiments, the present invention may be useful in a variety of industries or applications. In addition to the fencing industry, for example, certain embodiments of the present invention may also be utilized for removing staples in power utility applications (e.g., wooden power poles). In power utility applications, for instance, the confines of the elevated bucket or cherry picker used by a linesman along with the bulky protective gloves utilized by the linesmen makes the one handed feature provided by certain embodiments of the present invention particularly desirable. Moreover, in certain embodiments, long and carefully weighted handles that open without having to prise the tool open may be particularly helpful to a linesman. These features, for example, eliminate clumsy and bulky two handed alternatives to improve linesman safety as linemen can easily remove a staple with just one hand on the tool in accordance with certain embodiments of the present invention.

The present invention, in accordance with certain embodiments of the present invention, offers notable advantages over the prior art by, for example, including: (i) improved ease of use in removing staples from fence battens or the like; and (ii) improved ease of use in tensioning a fencing wire.

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

Unless the context clearly requires otherwise, throughout the description and the claims, the words "comprise", "comprising" and the like, are to be construed in an inclusive sense as opposed to an exclusive or exhaustive sense, that is to say, in the sense of "including, but not limited to".

This specification is also based on the understanding of the inventor regarding the prior art. The prior art description should not be regarded as being authoritative disclosure on the true state of the prior art but rather as referencing considerations brought to the mind and attention of the inventor when developing this invention.

These and other modifications and variations to the present invention may be practiced by those of ordinary skill in the art without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

What we claim is:

1. A method of removing a staple, comprising:

(i) providing a tool comprising:

a jaw portion comprising a pair of jaws;

a hinge portion configured to allow each jaw of the pair of jaws to pivot between an open position and a closed position relative to each other and to form an aperture adjacent a tip of each jaw of the pair of jaws when the pair of jaws are in the closed position;

a handle portion on an opposite side of the hinge portion from the jaw portion to allow for the pair of jaws to pivot between the open position and the closed position; and at least one projection extending outwardly from a face of each jaw of the pair of jaws at a position adjacent the tip of each jaw of the pair of jaws such that the at least one projection slants inwardly toward an axis of opening symmetry of the pair of jaws;

(ii) positioning the tool into a crook of a fence staple by inserting the tip of each jaw into the crook of the fence staple; and (iii) removing the fence staple from a support structure with the tool, wherein positioning the tool into the crook of the fence staple further comprises contacting the support structure with a top surface of the at least one projection such that the at least one projection acts as a fulcrum for applying a levering force to the fence staple grasped by the pair of jaws when in the closed position, wherein the top surface is distal from the face of each jaw from which the at least one projection extends, wherein the top surface of the at least one projection when the pair of jaws are in the closed position is within an inclusive range of 1 to 10 mm of a tangential line at the tip of each of the pair of jaws, the tangential line being substantially perpendicular to the axis of opening symmetry as the pair of jaws open outwardly into the open position.

2. The method as claimed in claim 1, wherein the top surface of the at least one projection comprises a gripping or anti-slip surface.

3. The method as claimed in claim 1, wherein a cross-sectional area of the top surface of the at least one projection is at least 20 $mm^2$.

4. The method of claim 1, wherein a shape of the at least one projection is selected from the group consisting of: cylindrical, conical, frustoconical, pyramidal, cuboid, and a parallelepiped.

5. The method of claim 1, wherein the at least one projection extends a minimum of 7.5 mm from the face of each jaw of the pair of jaws.

6. The method of claim 1, wherein the at least one projection extends a minimum of 12.5 mm from a center plane of each jaw of the pair of jaws.

7. The method of claim 1, wherein the at least one projection is integrally formed into each jaw of the pair of jaws.

8. The method of claim 1, wherein a distance of closest approach between a primary load-bearing area of the at least one projection on each jaw when the pair of jaws is in the closed position is within an inclusive range of 8 to 35 mm.

9. The method of claim 1, wherein the aperture is substantially circular.

10. The method of claim 1, wherein the aperture accommodates a wire with a diameter in a range of 1.6 mm to 4.5 mm.

11. The method of claim 1, wherein the hinge portion comprises a single pivot connecting the pair of jaws.

12. The method of claim 1, wherein the hinge portion comprises a multiple pivot point hinge arrangement with mechanical linkages connecting the pair of jaws.

13. The method of claim 1, wherein the jaw portion is integral with the handle portion.

14. The method of claim 1, wherein the handle portion comprises one or more of the following features: cushioning, gripping modifications, moulded portions for accommodating fingers, telescoping closure limiting features which set a minimum distance of approach when the pair of jaws is in the closed position.

15. The method of claim 1, wherein the jaw portion further comprises a wire cutting feature.

16. The method of claim 1, wherein the jaw portion further comprises a cable crimping feature.

17. The method of claim 1, wherein the tip of at least one jaw of the pair of jaws is fine enough to insert and fit at least half-way under the crook of a 2.5 mm gauge fencing staple.

18. The method of claim 1, wherein the tip of at least one jaw of the pair of jaws is fine enough to insert and fit at least half-way under the crook of a 4 mm gauge fencing staple.

19. The method of claim 1, wherein the tip of at least one jaw of the pair of jaws is tapered towards an end of the tip.

20. The method of claim 1, wherein the tip of at least one jaw of the pair of jaws is less than 1.75 mm across.

21. The method of claim 1, wherein a cross sectional area of the tip of at least one jaw of the pair of jaws is less than 2 $mm^2$.

22. The method of claim 1, wherein the jaw portion comprises metal.

23. The method of claim 22, wherein the metal is a stainless steel or an alloy steel.

* * * * *